United States Patent [19]

Eldridge

[11] 4,359,214

[45] Nov. 16, 1982

[54] APPARATUS FOR FEEDING FLAT ARTICLES

[75] Inventor: Charles W. Eldridge, Beverly, Mass.

[73] Assignee: Paxall, Inc., Chicago, Ill.

[21] Appl. No.: 218,476

[22] Filed: Dec. 22, 1980

[51] Int. Cl.[3] ..... B65H 3/04

[52] U.S. Cl. ..... 271/5; 271/6; 271/35; 271/99; 271/104; 271/108

[58] Field of Search ..... 271/5, 6, 99, 104, 35, 271/112, 108

[56] References Cited

U.S. PATENT DOCUMENTS

| | | | |
|---|---|---|---|
| 2,449,690 | 9/1948 | Chapman | 271/26 |
| 2,862,709 | 12/1958 | Labombarde | 271/99 X |
| 3,406,963 | 10/1968 | Goss | 271/35 |
| 3,674,255 | 7/1972 | Arnell | 271/99 X |
| 3,861,669 | 1/1975 | Kubo | 271/104 X |
| 3,907,278 | 9/1975 | Jaton | 271/35 X |

*Primary Examiner*—Richard A. Schacher

*Attorney, Agent, or Firm*—Fitch, Even, Tabin, Flannery & Welsh

[57] ABSTRACT

A feeder has an endless belt conveyer which removes flat articles one-by-one from the bottom of a stack and transports them downstream to a delivery point. A chamber is connected to a vacuum source in timed sequence to apply a vacuum through apertures in the belt to pull the underside face of the lowermost article against the upper surface of the moving belt. Further, restraining chambers are connected to a vacuum source to engage the article next thereabove and prevent its premature downstream travel.

10 Claims, 3 Drawing Figures

APPARATUS FOR FEEDING FLAT ARTICLES

The present invention relates to apparatus for feeding flat articles and more particularly to apparatus which feeds flat articles one-by-one from the bottom of a stack in a precise manner.

BACKGROUND OF THE INVENTION

Flat items, such as packaging blanks, paper sheets, inserts, mailing packets, etc., are often fed one at a time from a stack to apparatus for further processing. In many applications, it is necessary that the flat items be delivered to register with the timed operation of the apparatus.

A variety of feeding apparatus have been employed in the packaging industry including combing wheel feeders, reciprocating vacuum feeders, such as that described for right angled feed in U.S. Pat. No. 2,449,690, bump feeders, such as that described in U.S. Pat. No. 3,406,963 in which a stack is alternately lifted from and lowered onto a feed belt in order to feed articles one-by-one from the bottom of the stack, and rotary placers. All of the feed systems used have certain disadvantages. Some feeder designs are inherently limited in speed and unnecessarily slow down the entire processing line. Some require such precise adjustment that very skilled operators are needed to run the feeders. Those which feed from the top of a stack may be difficult to load. Some may be very difficult to adjust to accommodate various size articles. Bump feeders lack positive engagement of the apparatus with the article, a drawback particularly disadvantageous when feeding articles with slick coatings or articles with ridges or scorelines which tend to interlock. The bending of the articles by right angle feeders is undesirable in many applications.

The need exists for improved flat article feeders which positively engage articles and discharge them one-by-one in a precise manner.

SUMMARY OF THE INVENTION

Feeder apparatus is provided in which flat articles, stacked in a hopper, are fed one-by-one from the bottom of the stack to a downstream delivery point by a continuous apertured belt. A chamber is disposed below the upper segment of the continuous belt and a vacuum is periodically applied to the chamber which operates through apertures in the belt to pull the lowermost article against the moving belt for downstream travel. Additional chambers are provided to which a vacuum is periodically applied to engage the lowermost article and thereby retard downstream movement of the article until the vacuum is released.

DETAILED DESCRIPTION OF THE PREFERRED EMBODIMENTS

Figure 1:
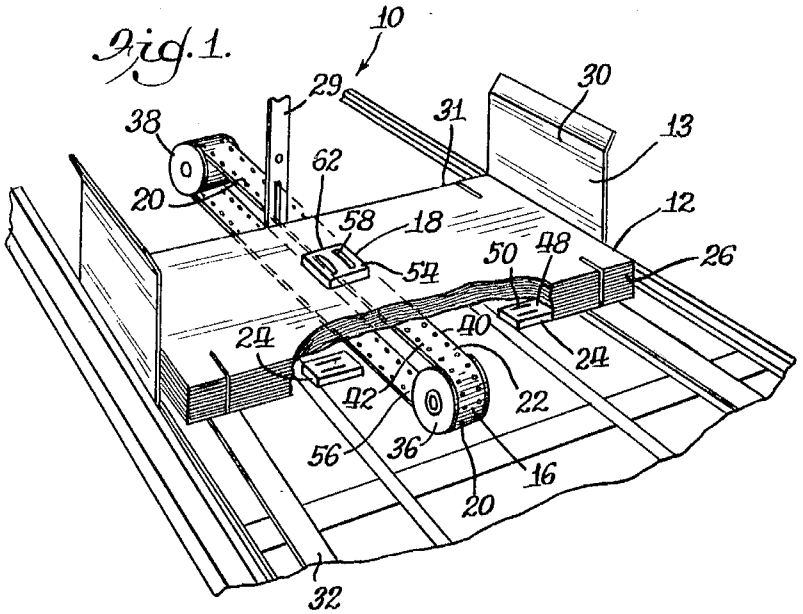
FIG. 1 is a perspective view of a flat article feeder embodying various features of the invention.

In accordance with the present invention, a feeder 10 is provided for removing stacked flat articles, such as die-cut blanks 12 for forming a tray, one-by-one from a hopper 13 and delivering them to a downstream delivery point 14 (FIG. 3) in precisely timed sequence. The feeder 10 has an endless belt conveyer 16 and a downstream chamber member 18 which is connected through a valve 17 to a vacuum source 19 (FIG. 3) and vacuumized in timed sequence to evacuate the belt apertures 20 thereabove and vacuum-engage the underside face of the lowermost blank **12*a* with the upper surface 22 of the belt for downstream travel. Upstream chamber members 24 are connected to a source of vacuum through a valve 25 and vacuumized after the trailing edge 26 of the lowermost article 12*a* has traveled downstream therebeyond to engage and restrain downstream movement of the next lowermost blank 12*b*** until such time as it is to be conveyed downstream.

A stack of die-cut and scored fiberboard or chipboard blanks 12 for forming packing trays is shown in FIG. 1 in a hopper 13 from which they are fed, one-by-one, to the downstream delivery point 14. The tray blanks 12 are used for illustration purposes, and it is to be understood that the apparatus may be used to deliver a variety of flat articles formed of materials such as paper, cellophane, plastic, corrugated fiberboard, etc. The hopper 13 is defined by a pair of sidewalls 30, which are adjustably spaced apart a distance equal to the lateral or transverse dimension of the blanks 12 stacked therein, and by a downstream wall 29.

The blanks 12 in the hopper 13 are supported at each side by parallel skid bars 32 which extend downstream beyond the hopper 13. The skid bars 32, as shown, have smooth upper surfaces along which the blanks 12 slide downstream to the delivery point 14. Roller skids or air film skids may be alternatively employed to facilitate sliding the blanks 12 therealong.

The continuous belt 16 is entrained between a rear wheel 36 disposed behind or upstream of the downstream wall 29 of the hopper 13 and a front wheel 38 preferably disposed forward or downstream of the hopper. A horizontal upper segment 40 of the belt extends between the wheels and carries the blanks 12 from the hopper 13 to the downstream delivery point 14. At least one of the wheels 36 or 38 drives the belt 16 at a uniform speed. Two rows of evenly spaced apertures 20, for conducting air pressure changes in the downstream chamber member 18 to the blank 12, are located along the length of the belt 16. The upper surface 42 of the belt 16 is in contact with or very closely adjacent the underside face of the lowermost blank **12*a*. After the blank 12*a* has been discharged from the hopper 13, frictional engagement of the belt 16 with the blank may be sufficient to slide the blank downstream along the parallel skid bars 32. While in the hopper 13, however, the positive vacuum engagement provided by the upstream chamber members 24 is sufficient to override any frictional forces between the belt 16 and the blank 12. Preferably, the blanks 12 are supported by the skid bars 32 to only lightly touch or even very slightly clear the upper surface 42 of the belt 16 so that there is little or no rubbing of the belt against the lowermost blank 12*a* before vacuum is applied to the downstream chamber member 18. Alternatively, the upstream chambers 24 may be elevated slightly, relative to the belt 16, so that the stack angles downward toward the front of the hopper 13 to minimize contact between the lowermost blank 12*a* and the belt before vacuum is applied to the downstream chamber member 18**, recognizing that there may be some sagging in the blanks in the stack.

Preferably, the downstream delivery point 14 is sufficiently close to the downstream wall 29 so that the leading edge 31 of the lowermost blank 12*a* is received thereby while the trailing edge 26 of the blank is still in the hopper 13 and under vacuum control of the downstream chamber member. However, recognizing that the equipment should be sufficiently versatile to handle blanks of widely varying dimensions, a pair of idler, hold-down rollers 47 are preferably provided.

The downstream or feed chamber member 18 is disposed directly beneath the upper reach or segment 40 of the apertured belt 16, and its flat upper surface 54 is in surface contact with the under surface 56 of the belt 16. The elongated openings 58 in the chamber 18 are aligned in the direction of blank travel under the respective rows of belt apertures 20. The downstream chamber member 18 is connected through the feed valve 17 to the vacuum source 19 and alternatively to an air pressure source 61 (FIG. 3) of slightly greater than atmospheric pressure. When the valve 17 is switched to the vacuum source 19, the evacuation of air from apertures 20 passing above the chamber openings 58 draws the underside face of the lowermost blank 12*a* downward, thereby sealing the chamber and engaging the blank to the upper surface 42 of the apertured belt 16 which pulls the blank downstream. When valve 17 switches so the positive air pressure source 61 is connected to the chamber 58, the lowermost blank 12*a* is pushed away from the belt 16 by the air flowing through the apertures 20, breaking the seal formed between the belt and the blank. The downstream chamber member 18 is disposed toward the front of the hopper 13 with its downstream edge 62 generally aligned with the downstream wall 29 under which the blanks 12 pass and positively controls the lowermost blank 12*a* until it has traveled downstream of the hopper.

Figure 2:
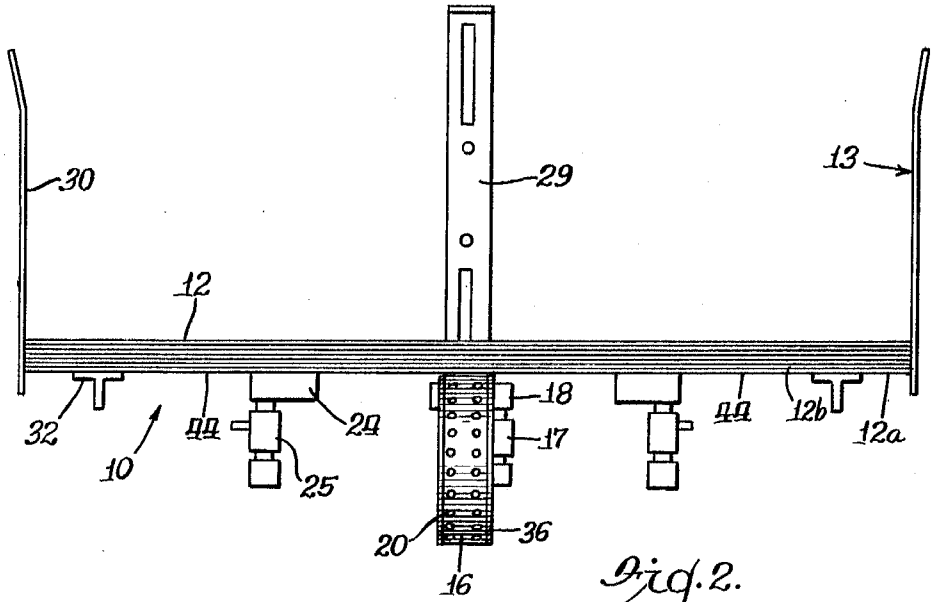
FIG. 2 is an end view, looking downstream from the hopper, of the feeder of FIG. 1.

The two upstream chamber members 24 are preferably spaced apart a distance greater than the width of the conveyer belt 16 and located to flank the belt. They provide balanced support for the carton blank and serve to retard progression of the lowermost blank 12*a* until desired and then serve to retard movement of the next lowermost blank 12*b* as the lowermost blank is being pulled from the bottom of the stack. The upstream chamber members 24 have flat upper surfaces 48 with openings 50 therein and are connected to a single valve 25 or each can be associated with an individual valve, as shown in FIG. 2. Each upstream or retard chamber member 24 may have a generally rectangular upper surface 48 and elongated openings; a single elongated chamber or more than two chamber members may alternatively be used. A suitably thin single chamber 24 could be located over the belt 16, relying upon the natural sagging of the blanks to achieve good vacuum connection with the undersurface in the region of the downstream chamber 18.

The valves 25 are connected to the vacuum source 19 and to the positive air pressure source 61 and are alternately switched to provide either positive or negative air pressure to the chambers. When the valves 25 are switched to the vacuum, the flat underside of the blank 12*a* directly thereabove closes the upper openings 50 and seals therewith, and the blank is restrained by the vacuum from downstream travel. When it is desired to release the lowermost blank 12*a* for downstream conveyance, the valves 25 are switched to provide a positive pressure to the chambers 50 which breaks the seal between the blank and the chambers 24 and reduces the friction between the retard chambers and the blank. Preferably, the valves 25 and 17 are 3-way valves biased to a center position to open the chambers to ambient atmosphere during shutdown of the feeder.

The downstream wall 29 is a vertical bar, the bottom end 64 (FIG. 3) of which is spaced from the upper surface 42 of the belt 16 slightly greater than one thickness of a blank 12 so that only one thickness of blank material may pass thereunder at a time to prevent several blanks from simultaneously traveling downstream. Preferably, the wall 29 is vertically adjustable so that it may be repositioned according to the thickness of the blanks 12 or other flat articles in the hopper 13.

Figure 3:
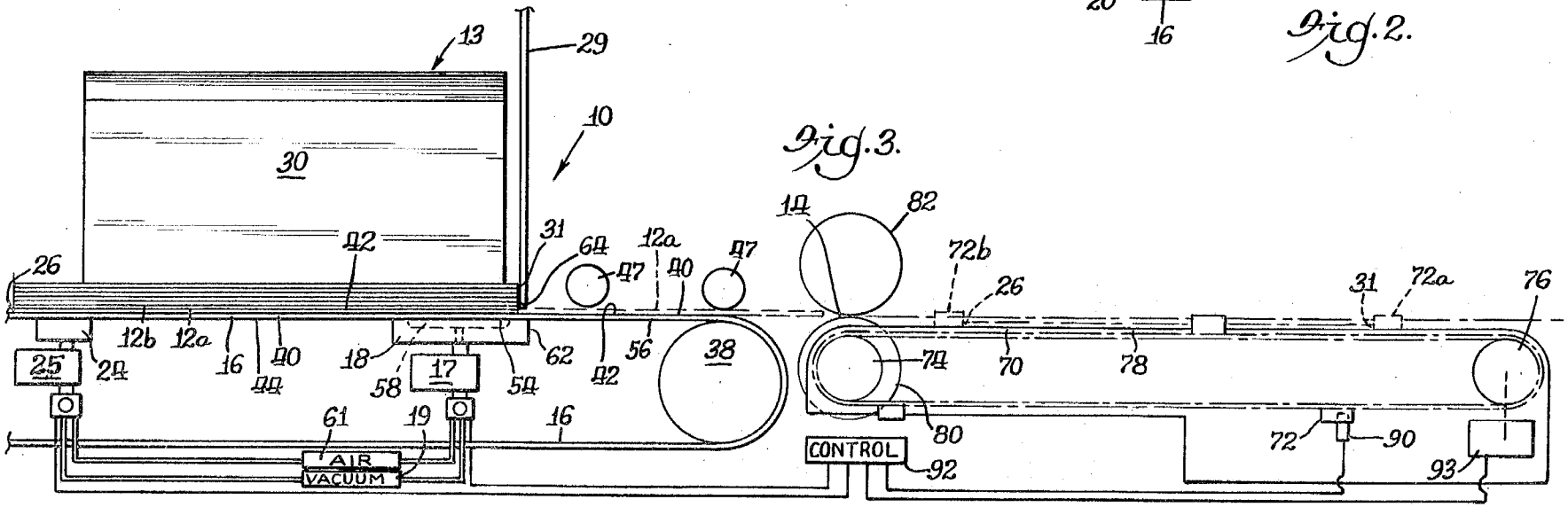
FIG. 3 is a side elevation view of the feeder shown in conjunction with a downstream conveyer which receives the articles therefrom.

The feeder 10 is illustrated in FIG. 3 in conjunction with a chain-driven conveyer 70 having spaced pusher dogs or register lugs 72 for precisely positioning the blanks 12 for further processing. The chain driven conveyer 70 is entrained around an upstream sprocket 74 and a downstream sprocket 76 which align the upper run or segment 78 of the belt generally in the plane of the upper reach 40 of the apertured feed belt 16. Lower pull-in rolls 80 are mounted coaxially from each end of the upstream sprocket 74 for rotation therewith, and they cooperate with aligned upper pull-in rolls 82 to provide a nip at the delivery point 14 which pulls the blank 12 from the feeder 10 and delivers it to the chain belt conveyer 70. A plurality of register lugs 72 are evenly spaced apart on the chain a distance somewhat greater than the corresponding dimension of the blanks 12, and the blanks are fed to the chain conveyer 70 in a precisely sequenced manner with the leading edge 31 of the blank 12 following one register lug 72*a* and the trailing edge 26 just ahead of the next register lug 72*b*. Although the blanks 12 are generally inserted onto the chain conveyer 70 slightly ahead of the following lug 72*b*, once on the chain conveyer, they are pushed along by the following lug and thereby delivered downstream in precise registration. The apertured feeder conveyer 16 and the chain conveyer 70 preferably operate at the same speed so there is no tendency for the blank 12 to twist as it transfers from the feeder to the chain belt conveyer. Spring fingers (not shown) will generally be disposed above the chain conveyer 70 to hold the individual blanks flat along the chain conveyer as they are carried thereby.

Associated with the chain conveyer 70 is a photoelectric eye 90 which detects each of the evenly spaced register lugs 72 passing thereby. The photoelectric eye 90 and the valves 25, 17 associated with the upstream and downstream chamber members 24, 18 are connected to a common control unit 92 which coordinates the actuation of the valves with the movement of the chain conveyer 70.

A control unit 92 which may be advantageously used includes a digital control loop having a counter with a pulses input from a digital encoder 93, e.g. a commercially available DRC Model 39, made by Dynamics Research Corp., Wilmington, Mass., mechanically tied to the rotary shaft of the chain conveyer drive sprocket 76. Thus, the control unit 92 actually "times" the operations sequence according to the spatial position of the constant speed chain belt conveyer 70 rather than using actual time. "Timing" by measurement of chain position prevents loss of coordination if the apparatus is stopped and restarted. The operator can independently adjust sequencing of the retard and feed valves 25, 17 electronically by thumb wheel switches. The delivery may be so precisely achieved even at high speed that the spacing between the lugs 72 can be as little as about one inch greater than the corresponding dimension of the blanks 12. Thus, the blanks 12 may be consistently fed to the chain conveyer 70 one after another at a rapid rate of blank feed.

To facilitate understanding of the feeder 10 and its associated receiving station, a cycle of operation will now be described in reference to FIG. 3. The feeder conveyer belt 16 and the chain conveyer 70 continuously move at the same constant speeds, while the retard chamber members 24 are connected to vacuum and restrain and trailing end of the lowermost blank 12*a*. The feed chamber member 18 is preferably connected to the positive air pressure source to reduce friction between the belt and the lowermost blank. At the start of each feed sequence, one of the register lugs 72 passes in front of and is detected by the photoelectric eye 90, and the signal generated is transmitted to the control unit 92. After the lug has moved a predetermined distance, which is determined by counting the pulses from the digital encoder since the detection of register lug 72, a signal is transmitted to the retard valves 25 to switch from vacuum to positive pressure thereby releasing the lowermost blank 12*a* for the downstream travel. Simultaneously the control unit 92 actuates the feed valve 17 to switch from positive pressure to vacuum and positively engage the underside of the lowermost blank 12*a* with the upper surface 42 of the apertured belt 16.

The engaged blank 12*a* is carried downstream under the vertical wall 29, and any initial tendency for the next lowermost blank 12*b* to follow is curbed by the downstream wall. After the conveyers have moved a further predetermined increment so that the trailing edge 26 of the lowermost blank 12*a* is at a position downstream of the retard chamber members 24, the control unit 92 transmits a signal which actuates the retard valves 25 to switch back to vacuum, drawing the trailing end of the next lowermost blank 12*b* against the chamber surfaces 50 and restraining any movement thereof.

When the leading edge 88 of the blank moves into the nip of the pull-in rolls 80, 82, the feed valve 17 is actuated to cut-off the vacuum open the downstream chamber to air pressure because the blank is now under the positive control of the pull-in rolls. For shorter blanks, vacuum may be retained until the blank has nearly cleared the hopper. The timing of valve actuation with the position of one of the register lugs 72 of the chain conveyer 76 provides for the entrance of each blank 12 onto the chain conveyer 70 immediately preceding the next successive lug 72*b* which is closely adjacent its trailing edge 26. As the blank 12 is being pulled through the nip of the pull-in rolls 80, 82, another lug 72 passes in front of the photoelectric eye 90 beginning the cycle again.

The coordinated operation of the upstream retard valve 25 and the downstream feed valve 17 permit the above cycle to be modified according to packaging needs. The actuation of the feed valve 17 to switch to vacuum may slightly precede or follow the activation of the retard valve 25 to switch to positive air pressure; however, it is preferably simultaneous. It may be advantageous to provide vacuum to the feed chamber member 18 slightly before the vacuum is released from the retard chamber members 24, which together provide a sufficiently strong restraining force to restrain the blank 12 even when the feed chamber member is switched to vacuum, so that the blank begins to move without hesitation upon release of retard chamber vacuum.

Several advantages of the present invention may now be more fully appreciated. The timing of the actuation of the retard and feed valves 25 and 17 which operate independently of one another, may be independently adjusted so that various size articles may be accommodated. For example, three additional lugs 72 could be added to the chain conveyer 70 to accommodate articles of about one-half the length. Because the sequencing is determined according to the position of the register lugs 72, the control unit 92 need not be reprogrammed for running the one-half length blanks. Furthermore, an operator may easily make fine adjustments in timing during operation to compensate for any slight variations of belt speed whereas previously it was necessary to slip the clutch of the receiving apparatus drive to match the speed of the feeder. Because the cycle is initiated by the signal from the photoelectric eye 90, which precisely determines the register chain position, and sequenced according to the actual distance the chain 70 thereafter moves, the sequencing by the control unit 92 is not skewed even if it is necessary to turn off the apparatus or not troubled by operation at different speeds. The feeder may be used to provide more accurate straightline feeding when exact feed register is not required. This advantage occurs from using the feeder to provide carton spacing as they are fed into the machine. Spacing is usually accomplished on straightline feeds by operating the feed belts at slower speeds than the main machine carrier belts. Since the feeder allows the feed belt to be operated at the exact speed of the main machine and still provide spacing, the tendency to twist cartons as they transfer from a belt of slower speed to a belt of higher speed is eliminated. Thus, this feeder provides an advantage for untimed straightline feeding as well as for timed or registered feed. When not used with a chain conveyer, initiation of the feed cycle is achieved by other suitable means, such as counting increments of belt travel to reach a preselected carton spacing.

The feeder 10 may be used in a wide variety of applications including folding cartons and corrugated containers. Examples include providing cellophane windows in timed sequence for cake box cover openings, applying coupons to sale literature, furnishing paper address labels to cartons, etc.

While the invention has been described in terms of a preferred embodiment, modifications obvious to one with ordinary skill in the art may be made without departing from the scope of the invention. For example, the photoelectric eye 90 may be replaced by a mechanical or other type of detector along the chain conveyer 70 which is tripped by the lug 72 or some other protrusion of the chain conveyer as it passes thereby. For wide blanks, two or more parallel apertured belts 16 having associated feed chambers 18 may be used.

Various features of the invention are emphasized in the following claims.

What is claimed is:

1. Apparatus for removing relatively flat articles from the bottom of a stack and delivering the articles one-by-one in sequence, which apparatus comprises;

a hopper for holding a stack of relatively flat articles, conveyer means adapted for continuous unidirectional operation that is located below said hopper and extends downstream to a delivery point, said conveyer means including an endless apertured belt, first chamber means disposed below said endless belt at a location below said hopper, second chamber means disposed below said hopper at a location upstream of said first chamber means, first means for connecting said first chamber means with a source of vacuum at a desired time proportional to the desired delivery sequence to cause the lowermost article in said hopper to be engaged by the upper surface of said belt and travel downstream, and second means for connecting said second chamber means with a source of vacuum independent of the connection of said first chamber means after said lowermost article has traveled downstream sufficiently for its trailing edge to have moved past said second chamber means so that the next lowermost article in said hopper is held in vacuum engagement by said second chamber means and restrained from following the lowermost article.

2. Apparatus in accordance with claim 1 wherein control means is provided for making said vacuum source connections, for disconnecting said first chamber means from said source following a desired amount of downstream travel of the lowermost article, and for disconnecting said second chamber means for said vacuum source when about ready for the feeding of the next lowermost article.

3. Apparatus in accordance with claim 1 wherein said hopper includes a vertically adjustable downstream wall which is adapted to allow passage thereunder of only one article thickness at a time.

4. Apparatus in accordance with claim 1 wherein said second chamber means includes a pair of chambers spaced apart a greater distance than the width of said endless belt.

5. Apparatus in accordance with claim 1 wherein said endless belt is entrained about forward and rearward rollers and said second chamber means is located upstream of said rearward roller.

6. Apparatus in accordance with claim 1 wherein means is provided for connecting both said chamber means with a source of air under greater than atmospheric pressure immediately upon disconnection from said source of vacuum.

7. Apparatus in accordance with claim 2 in combination with a timed feeding machine including a chain conveyer carrying a plurality of dogs, wherein said control means also includes means for sensing the location of one of said dogs and sending a signal from said sensing means to said control means, which signal serves as the basis for interconnecting said first chamber means and said source of vacuum.

8. Apparatus in accordance with claim 7 wherein said control means includes a rotary pulsed encoder connected to said chain conveyer and electronic digital means for varying the number of pulses that must be counted between receipt of said signal from said sensing means and said interconnecting.

9. Apparatus according to claim 1 wherein said second chamber means is located at a higher vertical level than said first chamber means.

10. Apparatus in accordance with claim 1 wherein pull-in roll means is located at the downstream end of said apertured belt conveyer.

* * * * *

UNITED STATES PATENT AND TRADEMARK OFFICE

CERTIFICATE OF CORRECTION

PATENT NO. : 4,359,214

DATED : November 16, 1982

INVENTOR(S) : Charles W. Eldridge

It is certified that error appears in the above—identified patent and that said Letters Patent is hereby corrected as shown below:

Column 3, line 14, change "The" to --Two--.

Column 4, line 56, change "pulses" to --pulsed--.

Column 5, line 12, change "and" to --the--,

Column 5, line 21, after "encoder" insert --93--,

Column 5, line 44, after "vacuum" insert --and--.

Column 7, line 28, change "for" to --from--.

Column 8, line 27, delete "said interconnecting" and insert --sending said signal for interconnecting said first chamber means and said source of vacuum--.

Signed and Sealed this

*Fifth* Day of *April 1983*

[SEAL]

*Attest:*

GERALD J. MOSSINGHOFF

*Attesting Officer*

*Commissioner of Patents and Trademarks*